US012426729B2

(12) United States Patent
Huffman et al.

(10) Patent No.: US 12,426,729 B2
(45) Date of Patent: Sep. 30, 2025

(54) CONNECTOR FOR FRAME

(71) Applicant: TRACER IMAGING LLC, Ossining, NY (US)

(72) Inventors: Jessica Huffman, Wilton, CT (US); Ryan Kelly, Queens, NY (US); Steven M. Spiro, Chappaqua, NY (US)

(73) Assignee: TRACER IMAGING LLC, Ossining, NY (US)

( * ) Notice: Subject to any disclaimer, the term of this patent is extended or adjusted under 35 U.S.C. 154(b) by 0 days.

(21) Appl. No.: 18/349,463

(22) Filed: Jul. 10, 2023

(65) Prior Publication Data

US 2025/0017397 A1 Jan. 16, 2025

(51) Int. Cl.
*A47G 1/17* (2006.01)
*A47G 1/06* (2006.01)

(52) U.S. Cl.
CPC ..... *A47G 1/175* (2013.01); *A47G 1/065* (2013.01); *A47G 2001/0661* (2013.01)

(58) Field of Classification Search
CPC ..... A47G 1/1606; A47G 1/17; A47G 1/175; A47G 1/065
See application file for complete search history.

(56) References Cited

U.S. PATENT DOCUMENTS

| | | | | |
|---|---|---|---|---|
| 4,610,418 | A * | 9/1986 | Graham | A47G 1/1606 248/495 |
| 5,507,464 | A * | 4/1996 | Hamerski | F16B 47/003 248/467 |
| 6,499,707 | B2 * | 12/2002 | Hamerski | A47G 1/175 248/205.3 |
| 9,970,475 | B2 * | 5/2018 | Chang | A47K 10/10 |
| 10,537,192 | B2 * | 1/2020 | Fastermann | A47G 1/202 |
| 11,419,436 | B2 * | 8/2022 | Spiro | G09F 15/0012 |
| 11,529,010 | B1 * | 12/2022 | Avery | A47G 1/175 |
| 11,578,833 | B2 * | 2/2023 | Woolman | A47B 96/06 |
| 11,690,464 | B2 * | 7/2023 | Spiro | A47G 1/17 40/747 |
| 11,974,680 | B1 * | 5/2024 | Davis | A47G 1/065 |
| 2019/0133347 | A1 * | 5/2019 | Kirschhoffer | A47G 1/20 |
| 2021/0337988 | A1 * | 11/2021 | Botzer | A47G 1/1633 |
| 2023/0145688 | A1 * | 5/2023 | Hill | A47G 1/1606 40/713 |
| 2023/0200570 | A1 * | 6/2023 | Spiro | A47G 1/202 248/475.1 |
| 2023/0371716 | A1 * | 11/2023 | Spiro | A47G 1/17 |

* cited by examiner

*Primary Examiner* — Bradley Duckworth
(74) *Attorney, Agent, or Firm* — Leason Ellis LLP

(57) ABSTRACT

A connector for repositionably securing a frame to a support surface includes a body having a first face, an opposite second face, a first side edge and an opposite second side edge. The connector has a non-permanent adhesive layer located along the first face and further includes an angled release tab that extends outwardly from the first side edge. One or more projections extend outwardly from the second face and are configured for being received within a rear of the frame for coupling the connector to the frame.

20 Claims, 11 Drawing Sheets

CONNECTOR FOR FRAME

TECHNICAL FIELD

The present application is generally directed to the field of frames, including a frame that is assembled by way of a snap-fit with a substrate, such as a canvas, being captured within and between two parts of the frame that are snap-fit together, and more particularly, a connector that is configured to be secured to a support surface, such as a wall, and is coupled to a rear of the frame for hanging the frame on the support surface.

BACKGROUND

For hundreds of years it has been customary to display photographs or other artwork on walls enclosed in picture frames. The design of these frames has virtually remained unchanged, consisting of a wooden molding outer frame with enclosed backer board, upon which a photograph is placed covered in part at the edges with a chipboard mat with bevel cut opening, covered by a pane of glass. A wire line draped from edge to edge on the backside of the frame is then used to hang the frames on a nail/hook or screw imbedded into the wall.

It's now desirable to have a picture frame product that is inexpensive, unbreakable, light weight and provides a non-wall-damaging displaying and repositioning system. More people are renting than ever before and deposits may be lost for damage done to wall. Also, many Offices, Dorm Rooms and Rental apartments have restrictions against making holes in walls.

There is therefore a need to provide a frame mounting system that permits the frame to be easily repositioned on the wall without damage, while also providing a secure mounting of the frame.

SUMMARY

A connector for repositionably securing a frame to a support surface includes a body having a first face, an opposite second face, a first side edge and an opposite second side edge. The connector has a non-permanent adhesive layer located along the first face and further includes an angled release tab that extends outwardly from the first side edge. One or more projections extend outwardly from the second face and are configured for being received within a rear of the frame for coupling the connector to the frame.

The connector is designed to engage and be coupled to a rear face of the frame and more particularly, the connector engages one or more hanging openings formed in the rear face of the frame.

BRIEF DESCRIPTION OF THE DRAWING FIGURES

The present invention may be appreciated by reference to the following descriptions and drawings, in which.

DETAILED DESCRIPTION OF CERTAIN EMBODIMENTS

Figure 1:
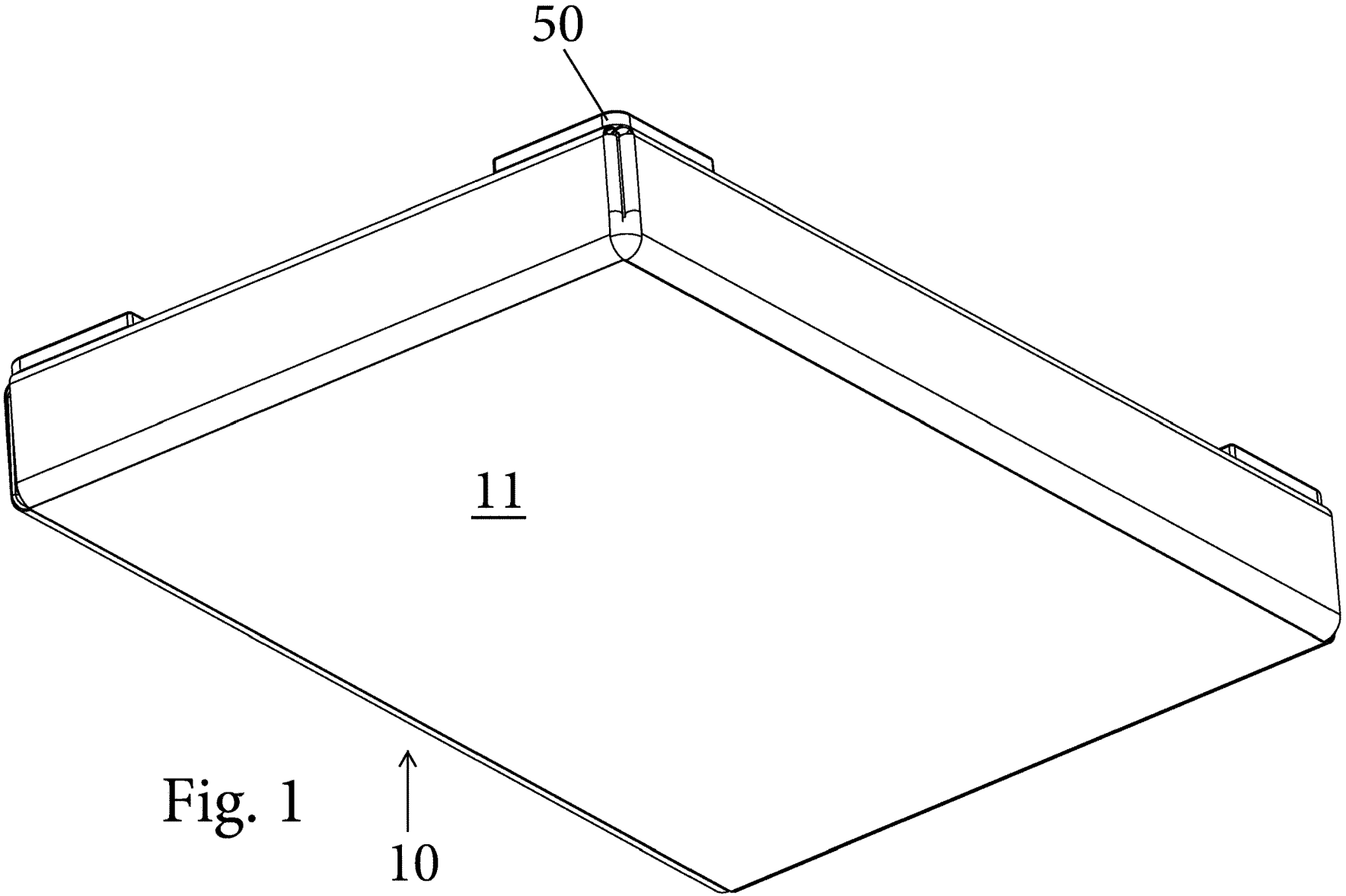
FIG. 1 is a perspective view of a frame (framed product)
Figure 2:
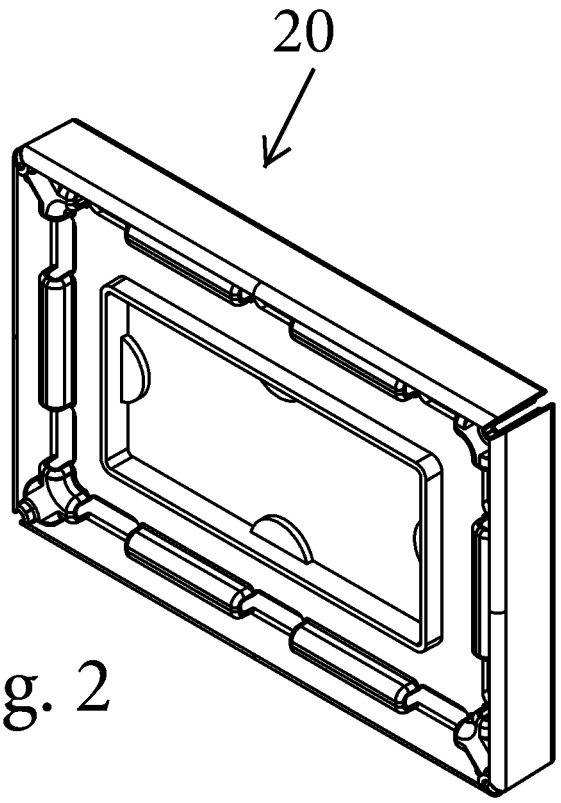
FIG. 2 is a front perspective view of a frame member (base) of a frame.
Figure 3:
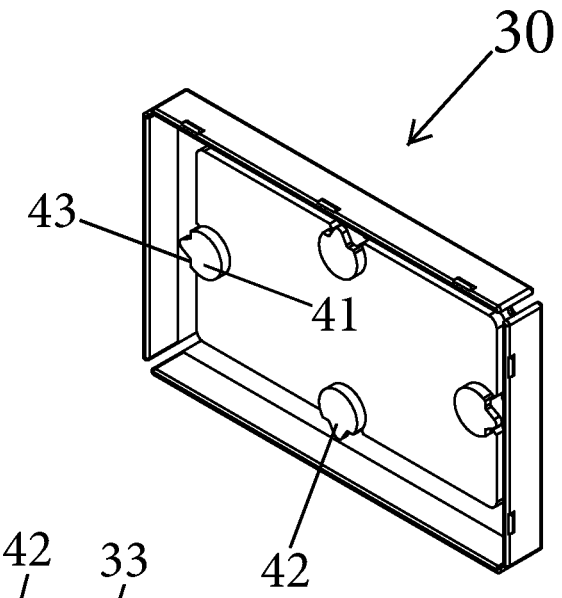
FIG. 3 is a front perspective view of a rear panel of the frame.
Figure 4:
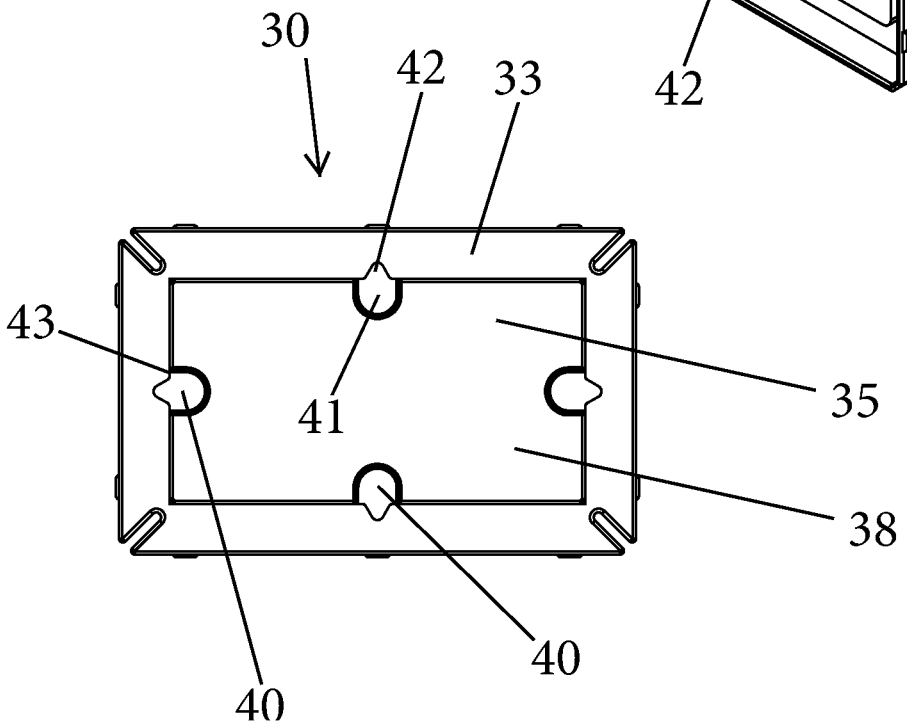
FIG. 4 is a rear elevation view thereof.

As discussed herein, the present invention is directed to a frame (e.g., framed product that contains a canvas print) and a connector for repositionable mounting the frame to a support surface, such as a wall. In addition, equipment that is used to assemble the frame is disclosed herein.

It will be appreciated, as disclosed herein, that the connector of the present application can be used with many different types of frames and therefore, the frame disclosed below and illustrated in the drawings is merely exemplary in nature and is not limiting of the scope of the present disclosure. In other words, as long as the rear of the frame is complementary to the coupling structure of the connector, the frame can be used with the disclosed connector.

Assembled Frame (e.g., Assembled Framed Canvas Print)

In accordance with one embodiment, one exemplary frame suitable for use in accordance with the present disclosure comprises a modular frame 10 (FIG. 1) for displaying an image, such as a printed canvas substrate 11 or other type of substrate. Additional details concerning the frame 10 are set forth in U.S. Pat. No. 11,419,436, issued on Aug. 23, 2022, which is hereby incorporated by reference in its entirety. The frame 10 can be considered to be an assembled frame product and can be formed of two parts that are constructed to interlockingly engage one another to capture and retain the canvas substrate 11 between the two parts with the canvas substrate 11 stretched over the outside of one of the parts. In the illustrated embodiment, one part comprises a frame member (frame base), shown at 20 (FIG. 215), and the other part comprises a rear panel, shown at 30 (FIG. 319). In the illustrated embodiment, the two parts interlock via a mechanical connection, such as a reversible snap-fit. The canvas substrate 11 is held taught (stretched) over the frame member (frame base) 20.

In one embodiment, the frame 20 and rear panel 30 are formed of a plastic material and can be formed as a molded structure.

The frame 20 represents the part that is placed into contact with the rear surface of a canvas substrate 11 and about which the canvas substrate 11 is folded. The frame 20 has a front face which faces the canvas substrate 11 and an opposite rear face that faces and engages the rear panel 30. The frame 20 has side walls and can have a center platform with a center hole. The center platform is connected to the side walls by a plurality of bridges or connectors (connecting walls).

Each of these connectors has a curved construction such that along the rear face and each connector has a concave appearance and defines a trough which functions as a groove or channel for receiving the canvas substrate 11. The troughs define a canvas receiving groove (channel) and more particularly, the groove or channel is defined between the troughs and the side walls. As described later, the canvas substrate 11 is received within and held taut (under tension) and in place within the groove due to the interaction and engagement between the rear panel 30 and the frame 20.

The rear panel 30 defines the rear of the display unit and includes a front face, an opposite rear face and a plurality of corners. The rear panel 30 can be formed to have any number of different shapes, such as a square or a rectangle (as shown).

The rear panel 30 has a rear wall or floor with a peripheral side wall that extends around the periphery of the floor. The front face of the rear panel 30 faces the frame 20, while the rear face faces away and defines the rear surface of the display unit. The rear face can include a center recessed area 38. Along the center recessed area 38 there can be a plurality of recessed openings 40 that are formed at select locations and as discussed herein, can be referred to as being hanging holes. In the illustrated embodiment, there are four openings 40 with each opening 40 having a U-shaped portion with a rounded peak portion (recessed extension) protruding outwardly from the U-shaped portion and formed in a border region that is elevated relative to the recessed area 38. The openings 40 can be arranged as two pairs, with one pair being directly opposite one another at ends of the recessed area 38 and the other pair being directly opposite one another at sides of the area 38.

The hanging openings 40 are arranged to permit the assembled display unit to be displayed in both portrait format and landscape format. Thus, one opposing pair of the openings 40 are for landscape format and the other opposing pair of the openings 40 are for portrait format. In addition, each opening 40 is specifically formed so as to receive multiple types of hanging hardware. For example, a traditional fastener, such as a nail or screw, can be used and inserted into the U-shaped portion and then slid into the rounded peak portion. In addition, the opening 40 is also sized to receive a head (e.g., mushroom shaped head) of a traditional suction cup to allow the display unit to be attached to a support surface (e.g., wall, mirror, etc.) using the suction cup. The head of the suction cup can be slid into the peak portion as well.

The frame 20 and rear panel 30 are configured to mate with one another so as to capture and retain the canvas substrate 11 in place and under tension over the front face of the frame 20. A mechanical fit (engagement) can be provided between the frame 20 and the rear panel 30. For example, a reversible snap-fit can be formed between the frame 20 and the rear panel 30. In the reversible snap-fit between the frame 20 and the rear panel 30 with the canvas substrate 11 being captured therebetween. In this engaged position, the hanging openings 40 face rearward and are open and accessible.

Hanging Opening 40

As shown in the figures, one exemplary hanging opening 40 has an irregular shape. The hanging opening 40 can includes a first region 41 and a second region 42. The first region 41 defines one end of the hanging opening 40, while the second region 42 defines the other end of the hanging opening 40. The first region 41 can be generally U-shaped, while the second region 42 is generally parabolic shaped. In addition, an interface 43 between the first region 41 and the second region 42 can comprise a shoulder that is formed at a right angle to the ends of the U-shaped first region 41. The width of the parabolic second region 42 is less than a width of the U-shaped first region 41. As shown, the heights of the first region 41 and the second region 42 can be different in that the first region 41 can be shorter than the second region 42 due to a stepped construction of the rear face of the rear panel 30.

In addition, within the second region 42, there can be an undercut (ledge) construction that permits a snap-fit connection with an external part as described herein. As shown in the figures, the rear face of the rear panel has a stepped construction with an outer perimeter border 33 being raised relative to a (recessed) center section 35 of the rear panel. The first region 41 is formed in the center section and the second region 42 being formed in the outer perimeter border and the interface 43 comprises a shoulder between the outer perimeter border and the center section. The interface 43, which can have a planar component, extends from legs of the U-shaped first region 41 to an entrance into the parabolic shaped second region 42. The interface 43 can comprise a planar interface located at an open end of the U-shaped first region 41 and laterally outside of an open end of the parabolic second region 42.

The first region 41 is closer to a center of the rear panel and the second region 42 is closer to an outer perimeter edge of the rear panel.

Corner Caps 50

Figure 5:
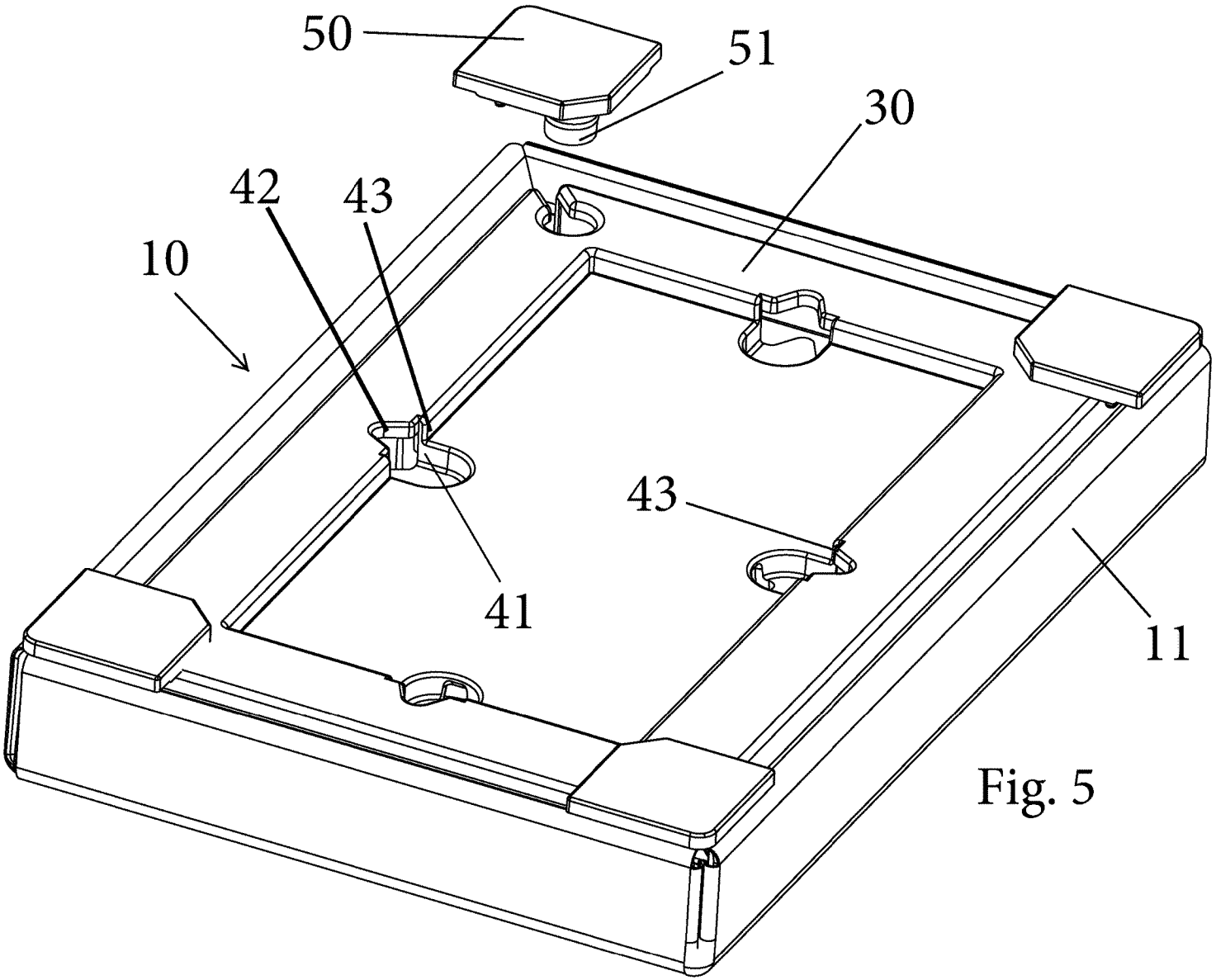
FIG. 5 is a rear and side perspective view of the assembled frame with corner caps.

Corner caps 50 can be provided to complete the rear corners of the rear panel 30. The corner caps 50 are configured to be attached (e.g., snap-fit) to the rear panel 30. As shown in FIG. 5, the rear face of the rear panel 30 includes a circular shaped recessed portion that receives a round protrusion 51 of the corner cap 50. The underside of the corner cap 50 can also include a smaller protrusion or rib that is received within a corner slot of the rear panel 30.

Connector 100

In accordance with the present disclosure, the connector 100 is provided for repositionably mounting the frame 10 to a support surface 10, such as a wall.

The connector 100 has a front face 102 and an opposite rear face 104. The front face 102 is the side (surface) that faces the rear panel 30, while the rear face 104 is the side (surface) that faces the support surface (e.g., wall). Each of the front face 102 and the rear face 104 is preferably a planar surface.

The connector 100 has a perimeter edge 105 that extends around the boundary of the connector 100. In the illustrated embodiment, the connector 100 can be generally oblong shaped with rounded corners. In this embodiment, the sides have longer lengths than the ends. However, it will be appreciated that in other embodiments, the connector 100 can have different shapes, including square shape or other shape.

The rear face 104 can include a repositionable adhesive layer 110 that is configured to allow the connector 100, as well as the attached frame 10, to be repositionably attached to the support surface (e.g., wall). The adhesive layer 100 can have a footprint (size) that is less than rear face 104 and the adhesive layer 100 extends outwardly from the rear face 104. In the illustrated embodiment, the adhesive layer 110 can have a rectangular shape. The adhesive layer 100 can include a coating of a non-permanent adhesive (repositionable microsphere adhesive) or can include a carrier, such as a tape, that has the non-permanent adhesive coated thereon. A removable release layer is provided and covers the non-permanent adhesive until the time of installation. Once removed, the non-permanent adhesive is exposed and can be placed in direct contact with the support surface for securely attaching the connector 100 to the support surface. In another embodiment, the adhesive layer 110 can comprise a layered structure that includes comprises a foam layer that is permanently bonded to the rear face 104 with the non-permanent adhesive layer coating on an outer surface of the foam layer that faces away from the rear face 104.

A release tab 120 extends outwardly from the perimeter edge 105 of the connector 100 and is configured to provide a tool by which the connector 100 can easily be lifted from the support surface. The release tab 120 comprises an angled tab that is formed along a first side edge 101 between ends of the connector 100. The angling of the tab 120 is in a direction away from the rear face 104 and the adhesive layer 110 since the release tab 120 is intended for access and manipulation when the adhesive layer 110 is in adhesive contact to the support surface. In other words, the underside of the release tab 120 must be accessible to place a finger or tool to lift the connector 100 off of the support surface. The free outer edge of the release tab 120 can be rounded.

The connector 100 also includes coupling features that are configured to couple the connector 100 to the rear panel 30. Preferably, the coupling between the connector 100 and the rear panel 30 is of a detachable type. For example, the coupling can be a snap-fit coupling between the connector 100 and the rear panel 30. The coupling between the connector 100 and the rear panel 30 utilizes the hanging openings 40. Since the hanging openings 40 represent female features, the connector 100 uses male features that are complementary to the female features. As illustrated, the connector 100 includes one or more coupling members 150 that are interlockingly received within one or more hanging openings 40. In the illustrated embodiment, there are two coupling members 150 that are received within two corresponding hanging openings 40 to (snap-fittingly) attach the connector 100 to the rear panel 30. While two coupling members 150 are shown for increased stability, the connector 100 can include only a single coupling member 150.

As mentioned, each coupling member 150 comprises a male projection that is sized and shaped to be snap-fittingly held within the hanging opening 40. The coupling member 150 thus contacts the inner walls of the hanging opening 40 resulting in the connector 100 being snap-fittingly held within hanging opening 40 as described herein. In the illustrated embodiment, the coupling member 150 generally comprises a T-shaped projection in that the coupling member 150 has a first leg 151 and a second leg 153 that is perpendicular to the first leg 151. The first leg 151 faces inward away from the end of the connector 100, while the second leg 153 extends across a width of the connector 100 and is generally parallel to the end. As shown, a nub 155 can be centrally located along the second leg 153 and extend from the second leg 153 toward or to one respective end of the connector 100. The height of the nub 155 is less than the heights of the first leg 151 and the second leg 153. The nub 155 can be coaxial with the first leg 151.

Figure 12:
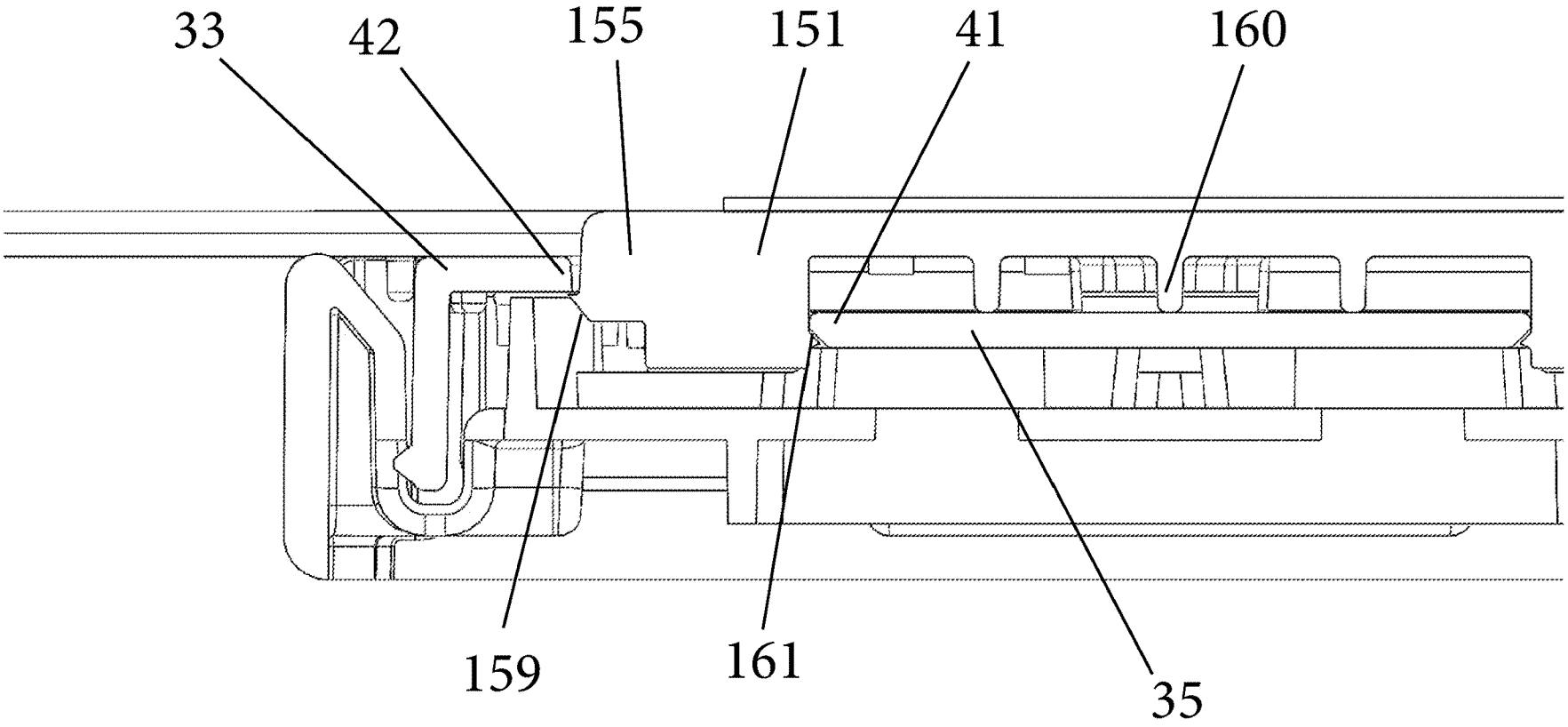
FIG. 12 is a cross-sectional view showing a snap-fit between the connector and a rear panel of the frame.

In one embodiment, as best shown in FIG. 12, along the outer edge of the nub 155, there can be a first hook 159 that is integrally formed with the nub 155 and protrudes outwardly from the nub 155. The first hook 159 is designed to engage the undercut (ledge) construction of the second region 42 to form a snap-fit. In addition, a second hook 161 can be formed along the exposed end of the first leg 151 and engages an undercut edge that is formed in the bottom of the U-shaped first region 41. For example, an opening can formed in the bottom of the U-shaped first region 41 to create the undercut edge along the bottom of the U-shaped first region 41. The second hook 161 is designed to engage the undercut (ledge) construction of the first region 41 to also form a snap-fit between the connector 100 and the rear panel.

In the illustrated embodiment, the hanging openings 40 that are the landscape hanging openings are utilized. These hanging openings 40 are spaced a first distance apart from one another across the rear panel 30. The size of the connector 100 is thus sized so that it extends across the rear panel 30 and positions the coupling members 150 in registration with the hanging openings 40. This arrangement allows the coupling members 150 to be inserted into the hanging openings 40 and a snap-fit fit results between the connector 100 and the rear panel 30. In other words, a snap-fit results between the connector 100 and the rear panel 30 with the connector 100 being located along the rear panel 30. It will be understood that as described herein, the connector 100 can be first installed on the support surface (wall) and then once the position of the connector 100 is finalized on the support surface, the frame 100 is attached to the connector 100 as described herein.

While a snap-fit is described as the means for coupling the connector 100 to the rear panel 30, other techniques, such as a friction fit or other coupling.

More specifically and according to one embodiment, the coupling member 150 is specifically constructed to mate with the hanging opening 40. In particular, when the coupling member 150 is inserted into the hanging opening 40, the nub 155 is received within the parabolic second region 42 and the second leg 153 can seat against the planar shoulder (interface 43) and the first leg 151 is received within the U-shaped first region 41. At the same time, the free end of the first leg 151 contacts the bottom of the U-shaped first region 41. The contact of the first leg 151 with the bottom of the U-shaped first region 41 and the seating of the second leg 153 against the planar shoulder (interface 43) results in a secure fit and attachment between the connector 100 and the rear panel 30. The second leg 153 thus can act as a guide for inserting the coupling member 150 into the hanging opening 40. In particular, the second leg 153 can be oriented and positioned against the interface 43 and then pressed down into the hanging opening 40.

The connector 100 can also have reinforcing and spacing features, such as ribs 160, that are located between the pair of coupling members 150. The ribs 160 extend across the width of the connector 100. In the illustrated embodiment, there are three ribs 160 that are oriented parallel to one another and formed at a 90 degree angle to the second face. It will be understood that the ribs 160 serve to support and space the middle part of the connector from the rear face of the rear panel of the frame and prevent and unwanted flexing of this intermediate area when the connector 100 and frame are being pressed against the support surface. As shown, the ends of the connector 100 are supported by the raised perimeter border of the rear panel and the ribs 160 seat against the recessed center section of the rear panel which results in the connector 100 being supported and lying in plane along its entire length (i.e., when a user presses down against the rear of the connector 100 along its length, it resists flexing).

In one embodiment, a plurality of connectors 100 can be arranged in a predetermined fixed pattern with at least one breakable finger 200 that connects one connector 100 to another connector 100. The at least one breakable finger 200 being detachably coupled to second side edges 103 of the one connector 100 and the other connector 100. The second side edge 103 is opposite the first side edge 101.

In the illustrated embodiment, each breakable finger 200 has an S shape with a first end 202 connected to the second side edge 103 of the one connector 100 and an opposing second end 204 connected to the second side edge 103 of the other connector 100. The attachment of the breakable finger 200 to the one connector 100 and to the other connector 100 is of a rupturable type in that upon application of force, the connection can be broken. In the illustrated embodiment, at the first end 202 there can be one or more breakable tabs (bridges) 210 and similarly, at the second end 204 there can be one or more breakable tabs 210. The breakable tabs 210 can be of reduced thickness relative to the rest of the finger to define a weakened area that is more susceptible to breaking.

The S-shape of the finger 200 serves to space the connectors 100 from one another and thus ensures that the mounted frames 100 are spaced apart in a desired orientation. In this way, the finger 200 serves as a guide since the user can first place the connector arrangement (i.e., two or more connectors 100 with one or more breakable fingers 200) against the wall. A level tool or the like can be used to orient the connector arrangement on the wall. Once the user is satisfied with the position of the connector arrangement, any release layers are removed from the non-permanent adhesive layers and the connector arrangement is pressed against the wall resulting in attachment thereto.

Figure 11:
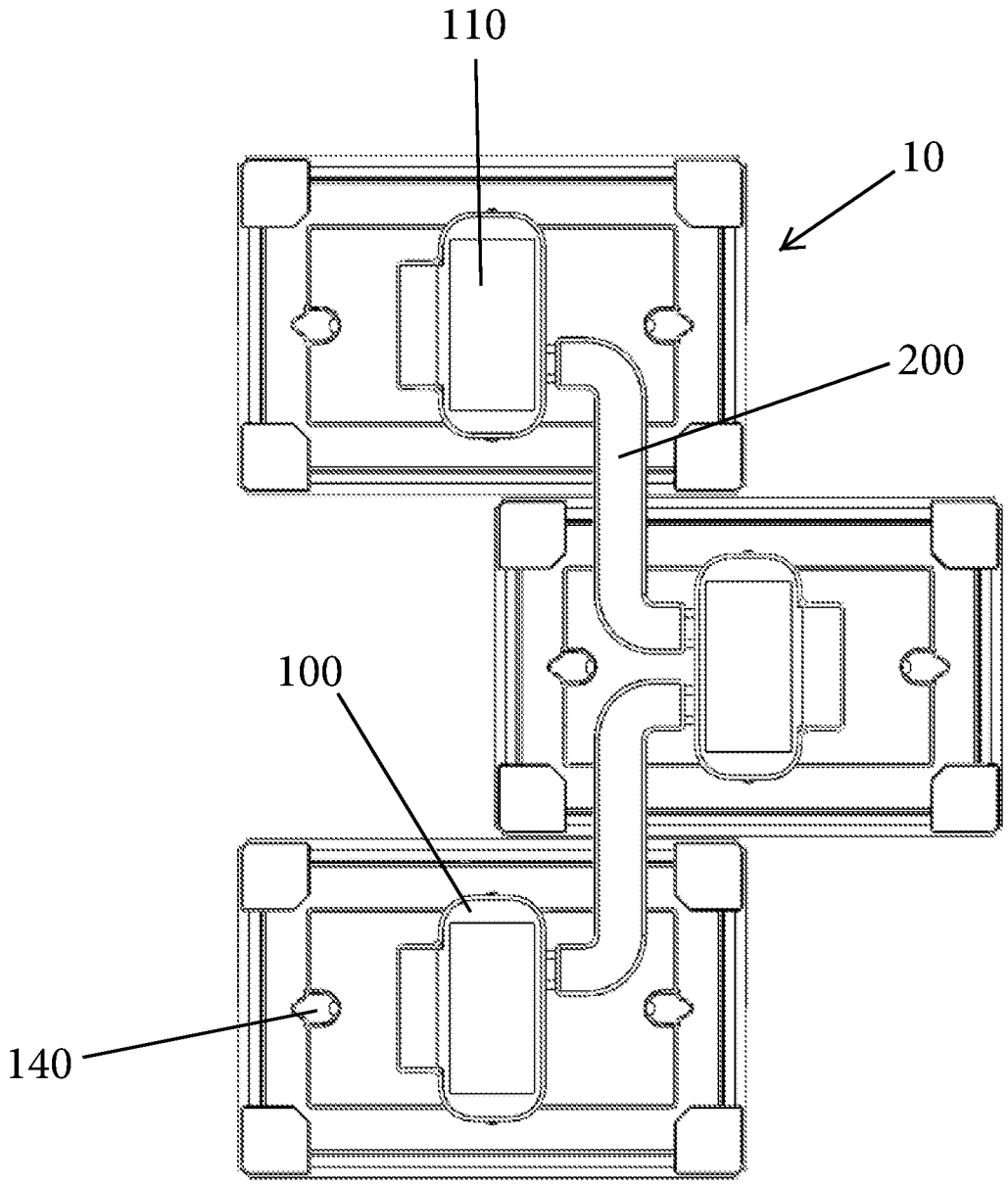
FIG. 11 is rear elevation view of the frame arrangement with the frame connector arrangement attached thereto.

Next, two or more frames 10 can be mounted as shown in FIGS. 8-11. For example, a first frame 10 is selected for attachment to one selected connector 100 and is attached thereto in the manner described herein and then a second frame 10 is selected for attachment to another selected connector 100. The process is repeated so that each connector 100 is mated to one frame 10. In the illustrated example, this results in three frames 10 being arranged as a displayed triplet on the wall. The connector arrangement eliminates the guess work and ensures proper uniform spacing between the frames 10. FIG. 11 shows the completed triplet frame arrangement. This spacing allows for an aesthetically pleasing frame triplet with proper, uniform spacing between the frames 10.

Figure 6:
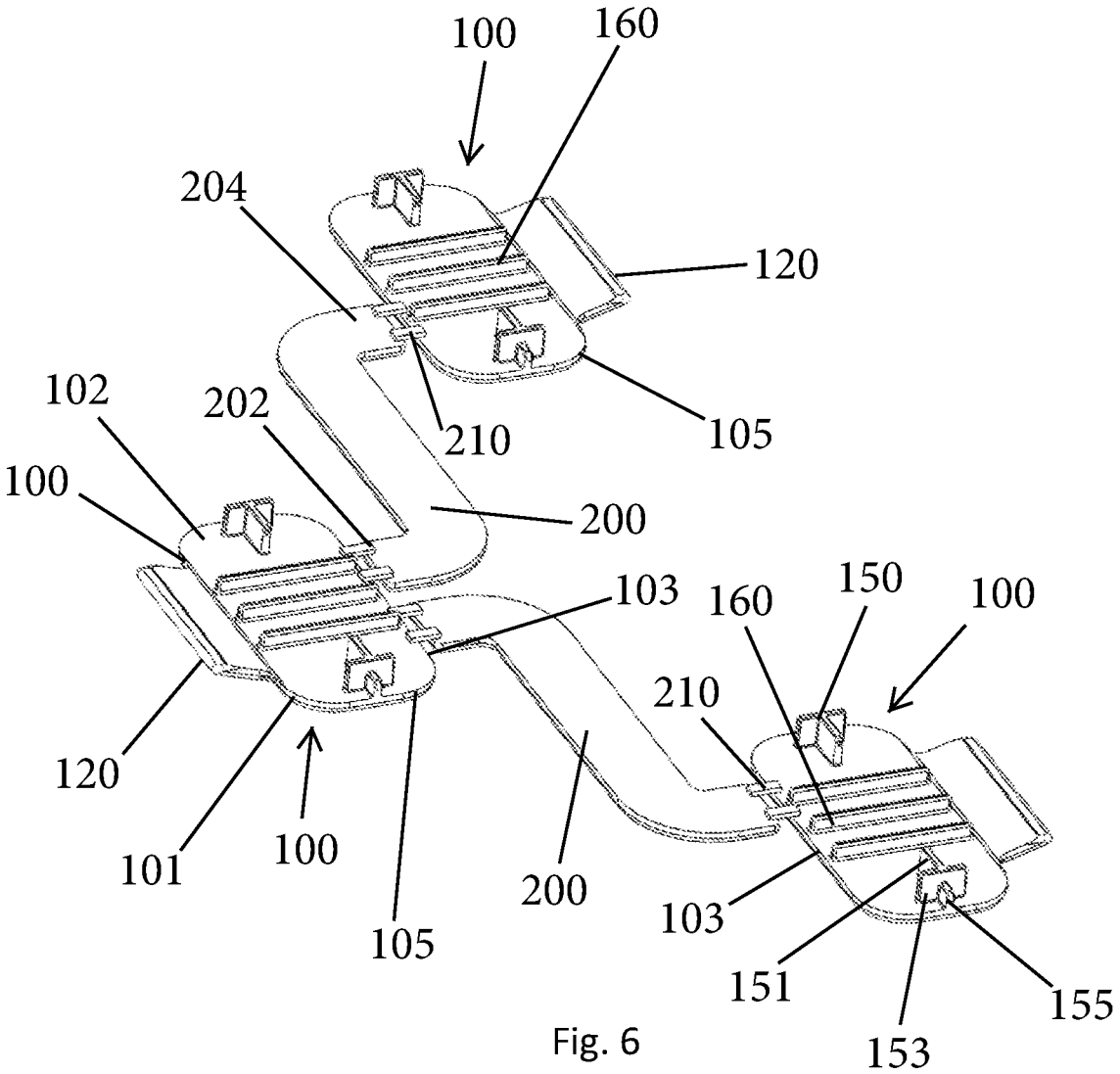
FIG. 6 is a front and side perspective view of a frame connector arrangement.
Figure 7:
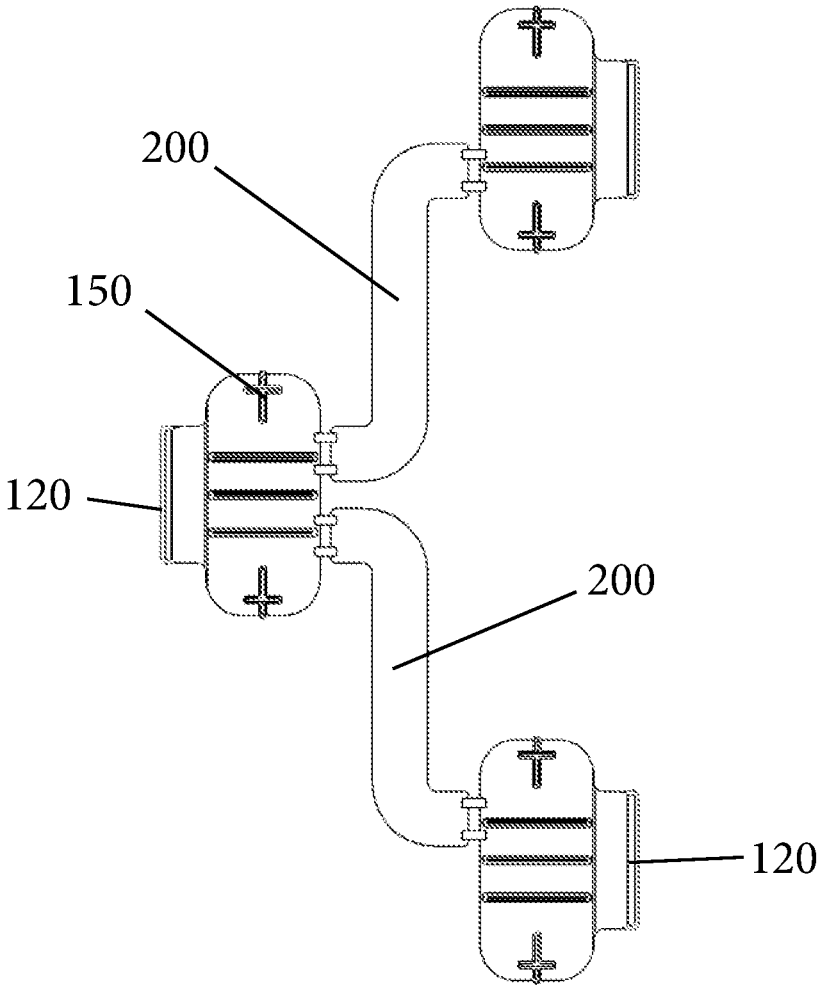
FIG. 7 is front elevation view of the frame connector arrangement.
Figure 8:
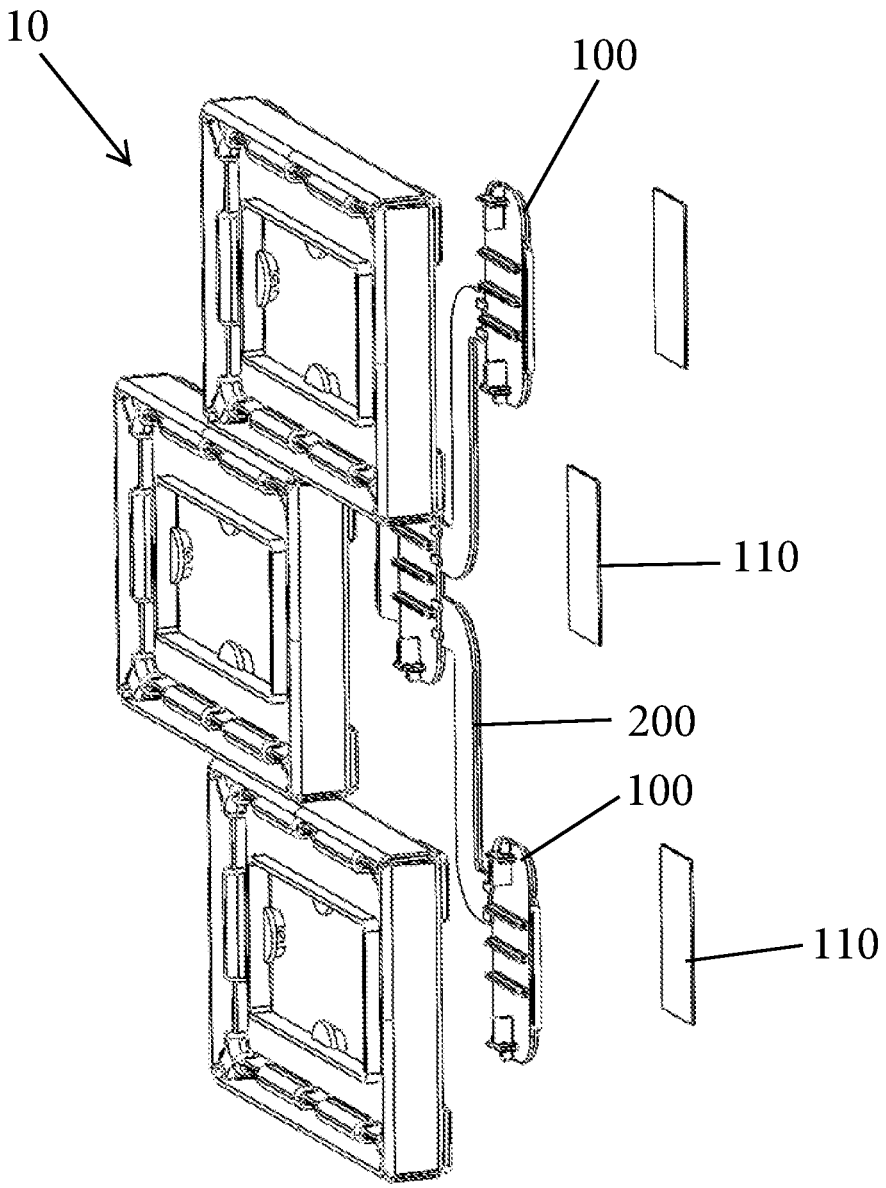
FIG. 8 is a perspective view of a frame arrangement with the frame connector arrangement.
Figure 9:
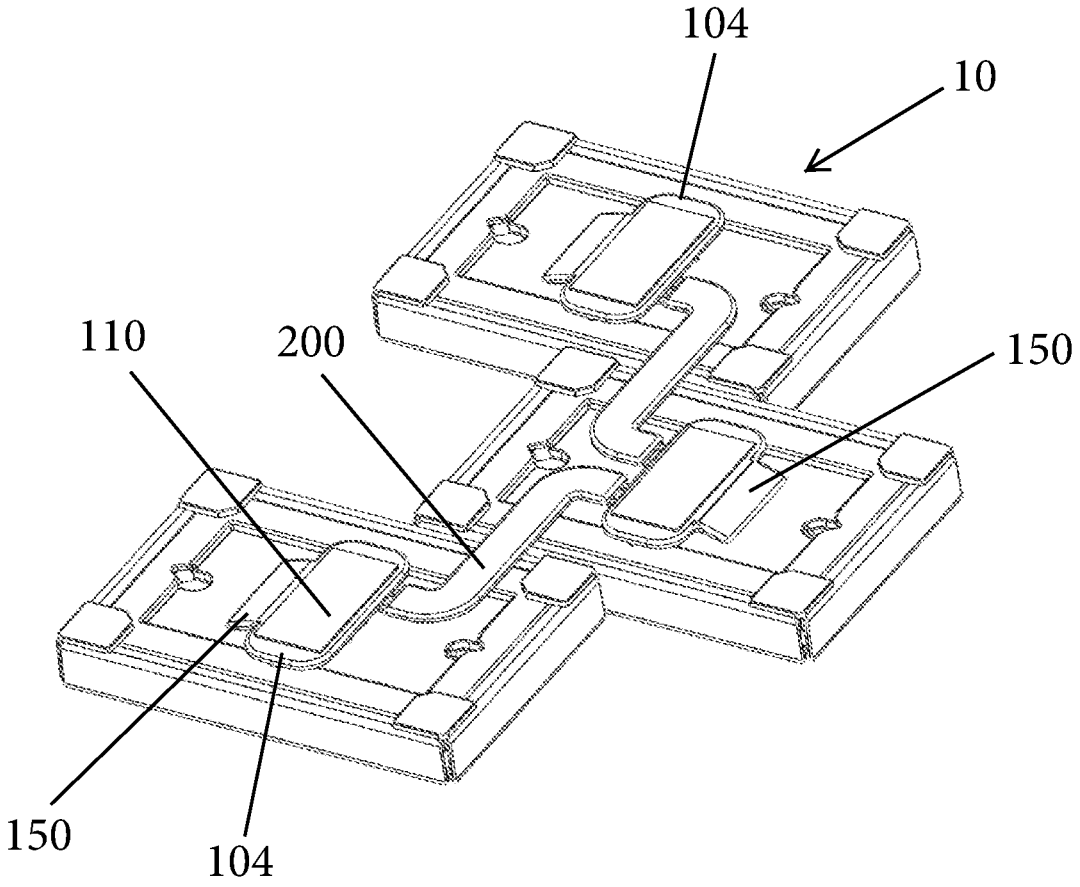
FIG. 9 is a rear perspective view of frame arrangement with the frame connector arrangement attached to the frame arrangement.
Figure 10:
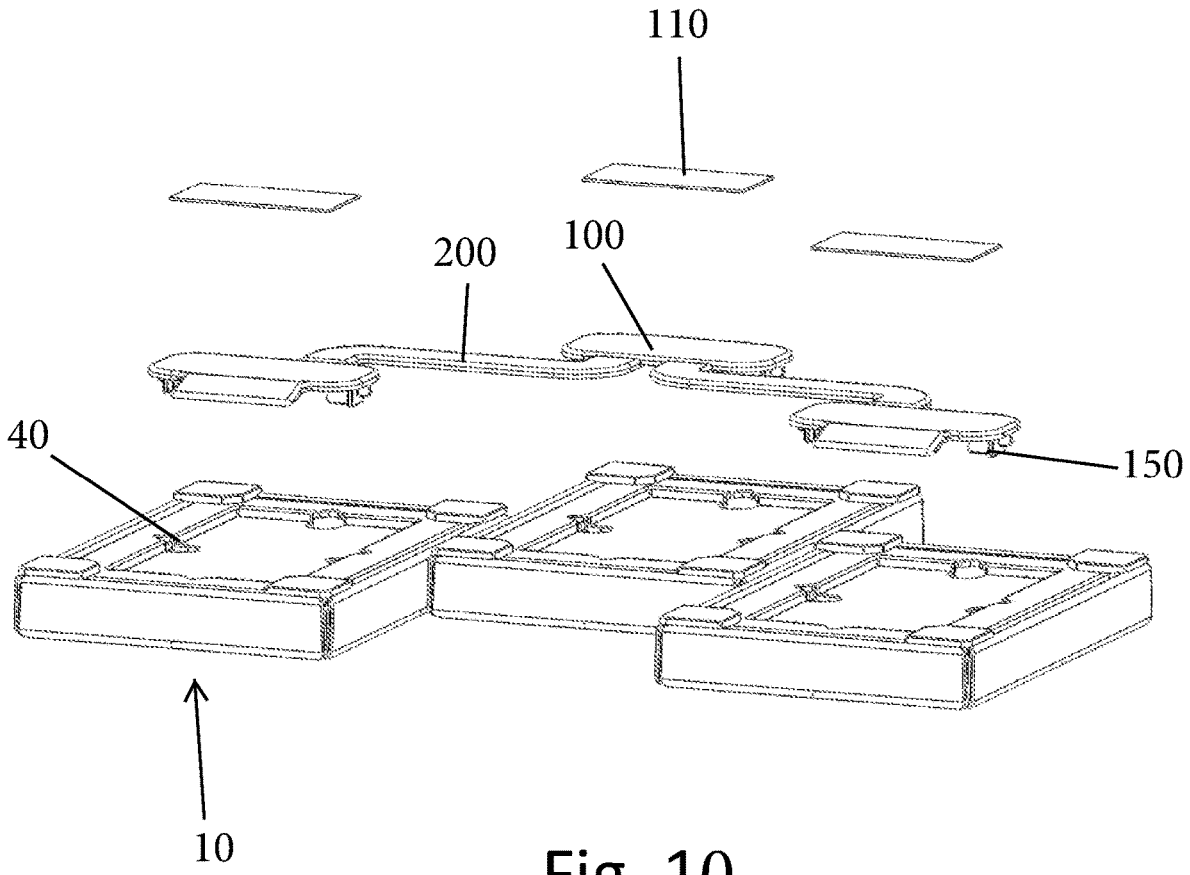
FIG. 10 is an exploded view of the frame arrangement with the frame connector arrangement.

FIGS. 6 and 7 show an arrangement of three connectors 100 with the middle connector 100 being attached to an upper connector 100 with one breakable finger 200 and the middle connector 100 also being attached to a lower connector 100 with another breakable finger 200. The two breakable fingers 200 are attached to the same side edge along the middle connector 100 resulting in the upper and lower connectors being laterally offset from the middle connector 100 and being positioned one on top of the other.

While the fingers 200 can be separated from the connectors 100, the arrangement can be left intact with the fingers 200 left in place behind the frames 100.

The plurality of connectors and the at least one breakable finger can be formed of plastic and the at least one breakable finger is integrally formed and connected to the one connector and the other connector.

Equipment for Assembling Display Unit

The equipment of the present invention has been configured to be easy to use and is simple in construction; however, the equipment effectuates assembly of the display unit 10 in an effective manner so as to allow complete assembly in a short amount of time. Exemplary equipment for assembling the frame 10 is also set forth in U.S. Pat. No. 11,419,436.

It is to be understood that like numerals in the drawings represent like elements through the several figures, and that not all components and/or steps described and illustrated with reference to the figures are required for all embodiments or arrangements.

Thus, illustrative embodiments and arrangements of the present devices and methods provide a method for applying a hair fastener. The flowchart in the figures illustrates the operation of possible implementations of methods according to various embodiments and arrangements. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the present disclosure, which is set forth in the following claims.

What is claimed is:

1. A connector for repositionably securing a frame to a support surface, the connector comprising:

a body having a first face, an opposite second face, a first side edge and an opposite second side edge, a non-permanent adhesive layer located along the first face;

an angled release tab that extends outwardly from the first side edge and is angled upward from the first face, wherein the angled release tab is integrally formed with the body; and one or more projections that extend outwardly from the second face and are configured for being received within a rear of the frame for coupling the connector to the frame;

wherein the one or more projections comprise a pair of T-shaped projections, each T-shaped projection having a first leg, a second leg formed perpendicular to the first leg and a nub that is coaxial to the first leg and protrudes outwardly from the second leg, the nub having an exposed first hook that protrudes outwardly therefrom and the first leg having an exposed second hook that protrudes outwardly therefrom, the first and second hooks being coaxial.

2. The connector of claim 1, wherein the non-permanent adhesive layer comprises a tape structure that is permanently attached to the first face.

3. The connector of claim 1, wherein the non-permanent adhesive layer comprises a foam layer that is permanently bonded to the first face with the non-permanent adhesive layer coating on an outer surface of the foam layer that faces away from the first face.

4. The connector of claim 1, wherein the body comprises an elongated body with the first and second side edges having lengths greater than lengths of two ends of the body.

5. The connector of claim 1, wherein the angled release tab is formed at an angle other than 90 degrees relative to both the first face and the second face.

6. The connector of claim 1, wherein a length of the release tab is less than a length of the first side edge.

7. The connector of claim 1, wherein an exposed outer edge of the release tab comprises a rounded edge.

8. The connector of claim 1, wherein the angled release tab is angled toward the second face so as to create a gap behind the angled release tab when the connector is positioned against the support surface.

9. The connector of claim 1, wherein the one or more projections comprise a pair of projections located at opposite ends of the body.

10. A connector and guide assembly for repositionably securing a frame to a support surface, the connector and guide assembly comprising:

a plurality of connectors, each connector comprising:

a body having a first face, an opposite second face, a first side edge and an opposite second side edge, a non-permanent adhesive layer located along the first face;

an angled release tab that extends outwardly from the first side edge; and one or more projections that extend outwardly from the second face and are configured for being received within a rear of the frame for coupling the connector to the frame; and at least one breakable finger that connects one connector to another connector, the at least one breakable finger being detachably coupled to the second side edges of the one connector and the other connector.

11. The connector and guide assembly of claim 10, wherein the at least one breakable finger has an S-shape.

12. The connector and guide assembly of claim 10, wherein the at least one breakable finger is connected at a first end to the second side edge of the one connector and is connected at a second end to the second side edge of the other connector, the first end including at least one breakable first bridge that attaches the at least one breakable finger to the second side edge, the second end including at least one breakable second bridge that attaches the at least one breakable finger to the second side edge.

13. The connector and guide assembly of claim 10, wherein the plurality of connectors and the at least one breakable finger are formed of plastic and the at least one breakable finger is integrally formed and connected to the one connector and the other connector.

14. A frame kit configured for being repositionably secured to a support surface, the frame kit comprising:

a frame having a rear face that includes one or more hanging openings;

a connector comprising:

a body having a first face, an opposite second face, a first side edge and an opposite second side edge, a non-permanent adhesive layer located along the first face;

an angled release tab that extends outwardly from the first side edge; and one or more projections that extend outwardly from the second face and are configured for being received within the one or more hanging openings of the frame for detachably coupling the connector to the frame;

wherein each hanging opening comprises a first region at a first end of the hanging opening and a second region at an opposite second end of the hanging opening, the first region being separated from the second region by an interface, the first region having a shape different than a shape of the second region.

15. The frame kit of claim 14, wherein the first region has a U-shape.

16. The frame kit of claim 14, wherein the first region has a U-shape and the second region has a parabolic shape.

17. The frame kit of claim 16, wherein the interface extends from legs of the U-shaped first region to an entrance into the parabolic shaped second region.

18. The frame kit of claim 16, wherein the interface comprises a planar interface located at an open end of the U-shaped first region and laterally outside of an open end of the parabolic second region.

19. The frame kit of claim 16, wherein the one or more projections comprise a pair of T-shaped projections, each T-shaped projection having a first leg, a second leg formed perpendicular to the first leg and a nub that is coaxial to the first leg and protrudes outwardly from the second leg, the nub having an exposed first hook that protrudes outwardly therefrom and snap-fittingly engages a first undercut edge formed in the parabolic shaped second region and the first leg having an exposed second hook that protrudes outwardly therefrom and snap-fittingly engages a second undercut edge formed in the U-shaped first region, the first and second hooks being coaxial.

20. The frame kit of claim 14, wherein the first region is closer to a center of the rear panel and the second region is closer to an outer perimeter edge of the rear panel.

* * * * *